US011201429B2

(12) United States Patent
Kobayashi

(10) Patent No.: US 11,201,429 B2
(45) Date of Patent: Dec. 14, 2021

(54) ELECTRICAL CONNECTOR

(71) Applicant: Hirose Electric Co., Ltd., Yokohama (JP)

(72) Inventor: Yuki Kobayashi, Yokohama (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/028,442

(22) Filed: Sep. 22, 2020

(65) Prior Publication Data

US 2021/0111506 A1 Apr. 15, 2021

(30) Foreign Application Priority Data

Oct. 11, 2019 (JP) ..... JP2019-187535

(51) Int. Cl.
*H01R 13/502* (2006.01)
*H01R 13/405* (2006.01)

(52) U.S. Cl.
CPC ..... *H01R 13/502* (2013.01); *H01R 13/405* (2013.01)

(58) Field of Classification Search
CPC ..... H01R 12/7005; H01R 12/7076; H01R 12/721; H01R 12/714; H01R 12/58; H01R 12/57; H01R 12/00; H01R 12/78; H01R 12/79; H01R 12/71; H01R 13/2457; H01R 13/6205; H01R 13/6683; H01R 13/453; H01R 13/518; H01R 43/26; H01R 24/00; H01R 24/60
See application file for complete search history.

(56) References Cited

U.S. PATENT DOCUMENTS 5,842,874 A * 12/1998 Yagi ..... H01R 12/716 439/74
5,915,975 A * 6/1999 McGrath ..... H01R 12/7088 439/74
7,591,669 B1 * 9/2009 Peng ..... H01R 12/716 439/489
7,632,107 B2 * 12/2009 Mizumura ..... H01R 12/00 439/74

(Continued)

FOREIGN PATENT DOCUMENTS

JP 2010-205475 A 9/2010

*Primary Examiner* — Abdullah A Riyami
*Assistant Examiner* — Nader J Alhawamdeh
(74) *Attorney, Agent, or Firm* — Procopio, Cory, Hargreaves & Savitch LLP

(57) ABSTRACT

To provide a technology for flexibly modifying terminal configurations in electrical connectors, the present disclosure involves a plug connector that includes a housing and multiple terminals held in place in the housing, wherein the housing includes a main body portion, in which the multiple terminals are arranged, and first exterior wall portions and second exterior wall portions, which are provided at both ends of the main body portion; the first and second exterior wall portions extend in a direction perpendicular to the array direction of the multiple terminals; the first exterior wall portions include a first coupling portion at the end in a first extension direction; the second exterior wall portions include a second coupling portion at the end in the same direction as the first extension direction; and the first coupling portion and the second coupling portion have mutually engageable shapes.

9 Claims, 10 Drawing Sheets

(56) References Cited

U.S. PATENT DOCUMENTS

| | | | | |
|---|---|---|---|---|
| 8,529,275 | B2 * | 9/2013 | Kagotani | H01R 43/205 439/41 |
| 8,858,239 | B2 * | 10/2014 | Little | H01R 24/84 439/74 |
| 9,728,873 | B2 * | 8/2017 | Komoto | H01R 13/405 |
| 10,056,710 | B1 * | 8/2018 | Yang | H01R 13/518 |
| D871,345 | S * | 12/2019 | Ashibu | D13/147 |
| 10,608,363 | B2 * | 3/2020 | Sano | H01R 13/5025 |
| 10,673,180 | B2 * | 6/2020 | Sano | H01R 13/506 |
| 2009/0176410 | A1 * | 7/2009 | Tutt | H01R 13/6586 439/607.05 |
| 2015/0236444 | A1 * | 8/2015 | Bdeir | H01R 13/6205 361/792 |
| 2017/0125930 | A1 * | 5/2017 | Komoto | H01R 12/716 |
| 2020/0067225 | A1 * | 2/2020 | Rossman | H01R 13/2421 |
| 2020/0067227 | A1 * | 2/2020 | Gondo | H01R 12/716 |
| 2021/0111506 | A1 * | 4/2021 | Kobayashi | H01R 12/716 |

* cited by examiner

ELECTRICAL CONNECTOR

CROSS-REFERENCE TO RELATED APPLICATIONS

This application claims priority to Japanese Patent Application No. 2019-187535, filed Oct. 11, 2019, the contents of which are incorporated herein by reference in its entirety for all purposes.

BACKGROUND

Technical Field

The present invention relates to electrical connectors and, in particular, to an electrical connector that may be used while being mounted on a circuit board.

Related Art

Face-to-face type connectors are used for electrically coupling multiple electrically conductive portions formed on a printed wiring board to multiple electrically conductive portions formed on another printed wiring board, or the like. Such connectors have a receptacle-side connector placed in electrical communication with electrically conductive portions on one wiring board, and a plug-side connector placed in electrical communication with electrically conductive portions on another wiring board. In order to accommodate an increase in the number of pins in such connectors, a multi-contact connector may be necessary. The technology described in Patent Reference 1 is suggested as an example of a multi-contact connector.

Patent References

Patent Reference 1

Japanese Unexamined Patent Application Publication No. 2010-205475.

SUMMARY

Problems to be Solved

For example, disposing terminals in a matrix arrangement has been contemplated to allow for flexibly accommodating an increase in the number of pins. In such a case, a need arises for a connector in which multiple terminals are arranged in an efficient manner while efficiently utilizing the mounting surface area of the circuit board. In addition, it would be convenient if the terminal configurations could be flexibly modified to accommodate the various types of equipment in which the connector is used.

Accordingly, it is an object of the present invention to provide a technology that allows for the flexible modification of terminal configurations in electrical connectors.

In addition, it is another object of the present invention to provide a technology that allows for multiple terminals in an electrical connector to be arranged in an efficient manner by efficiently utilizing the mounting surface area.

These and other objects and novel features of the present invention will become apparent from the description and accompanying drawings provided herein.

Technical Solution

The following is a brief summary of a representative embodiment among the exemplary embodiments disclosed in the present Application.

Namely, an electrical connector according to the representative exemplary embodiment includes a housing and multiple terminals held in place in the housing; the housing includes a main body portion, in which the multiple terminals are arranged, and first and second exterior wall portions, which are provided at both ends of the main body portion; the first and second exterior wall portions extend in a direction perpendicular to the array direction of the multiple terminals; the first exterior wall portions include a first coupling portion at the end in a first extension direction; the second exterior wall portions include a second coupling portion at the end in the same direction as the first extension direction; and the first and second coupling portions have mutually engageable shapes.

Technical Effect

The following is a brief summary of the effects obtained in the representative embodiment among the exemplary embodiments disclosed in the present Application.

It becomes possible to flexibly modify terminal configurations depending on the intended use.

Multiple terminals can be efficiently arranged by utilizing the mounting surface area in an efficient manner.

DETAILED DESCRIPTION

Figure 1:
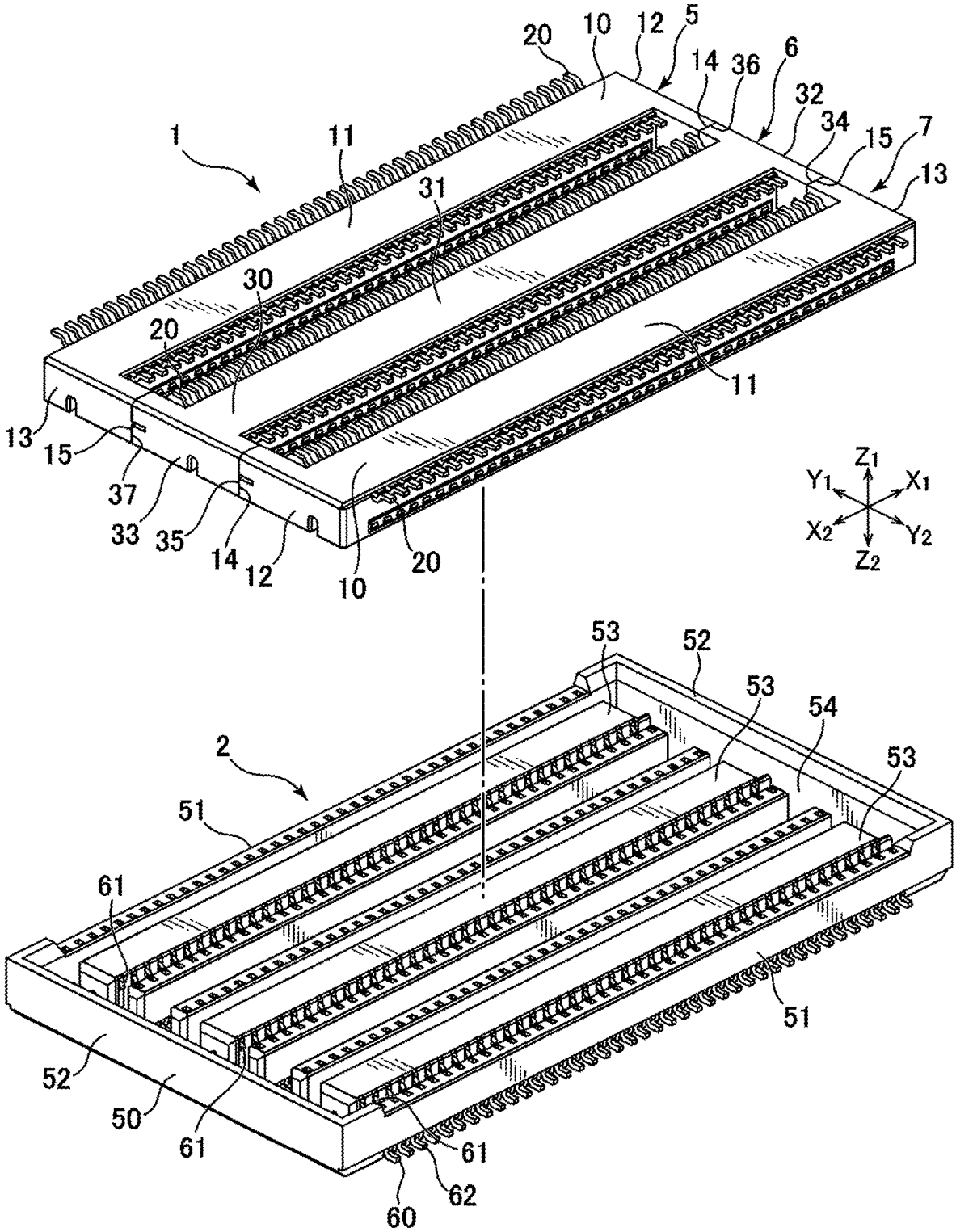
FIG. 1 is a perspective view illustrating the configuration of a plug connector and a receptacle connector according to an embodiment of the present invention.

Below, embodiments of the present invention are described in detail with reference to drawings. It should be noted that, in principle, like reference numerals are assigned to like parts in all the drawings used to illustrate the embodiments and further description thereof is omitted.

Although in the following embodiments, whenever necessary for convenience purposes, the description is divided into multiple sections or embodiments, unless clearly specified to the contrary, the sections are not mutually unrelated, and each one is related to some or all of the variations, details, and supplementary explanations of the other sections. In addition, in the following embodiments, when reference is made to the number of elements and the like (including numbers, numerical values, amounts, ranges, etc.), the number of elements is not limited to said particular number, and may be equal, greater or less than that particular number except in cases where it is clearly specified and in cases where it is limited to a clearly specified number as a matter of principle.

It should be noted that in the following embodiments, for ease of discussion, the longitudinal direction of the electrical connector (terminal array direction) is designated as the X ($X_1X_2$) direction, the transverse direction (direction in which the terminals are opposed) is designated as the Y ($Y_1Y_2$) direction, and the heightwise direction (direction of mating and unmating) is designated as the Z ($Z_1Z_2$) direction. It should also be noted that the directions are intended to describe the relative positional relationship of the parts constituting the connector and do not indicate absolute directions.

Figure 2:
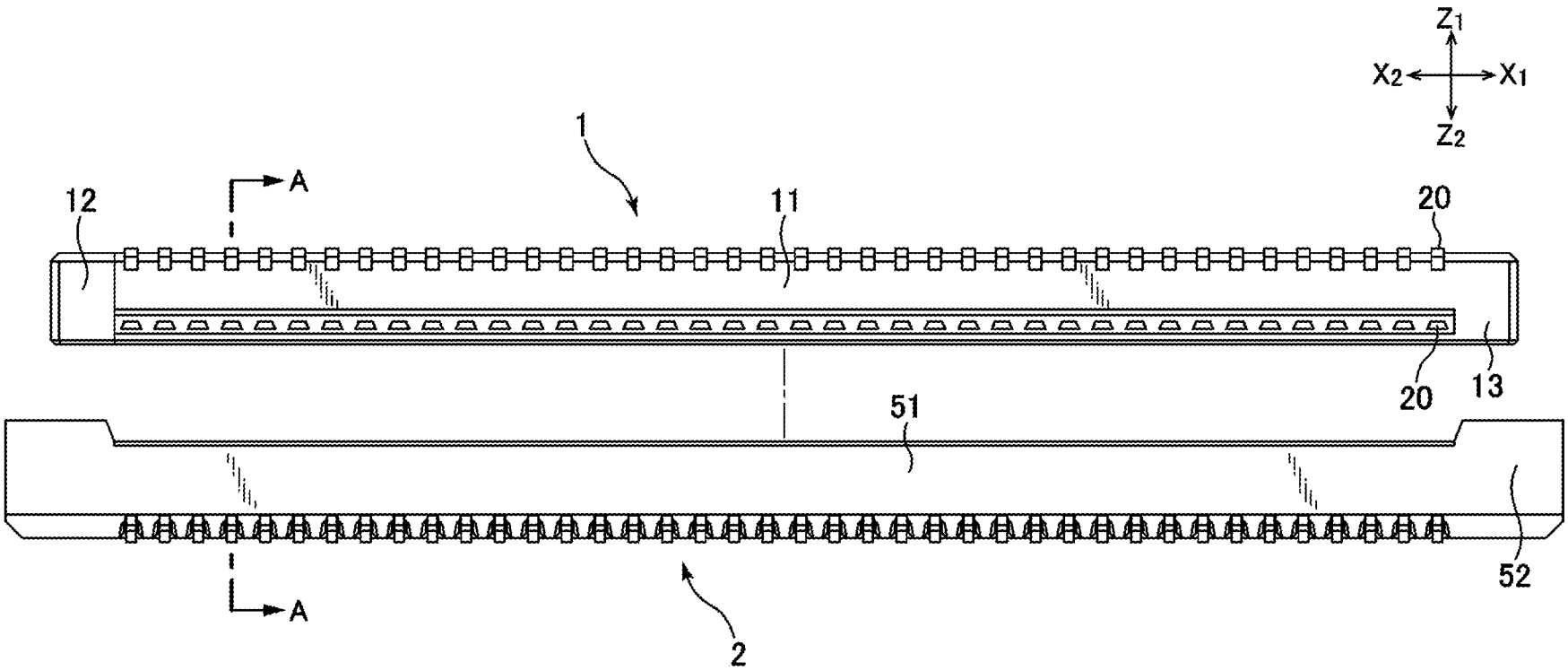
FIG. 2 is a front elevation view illustrating the configuration of a plug connector and a receptacle connector according to an embodiment of the present invention.
Figure 3:
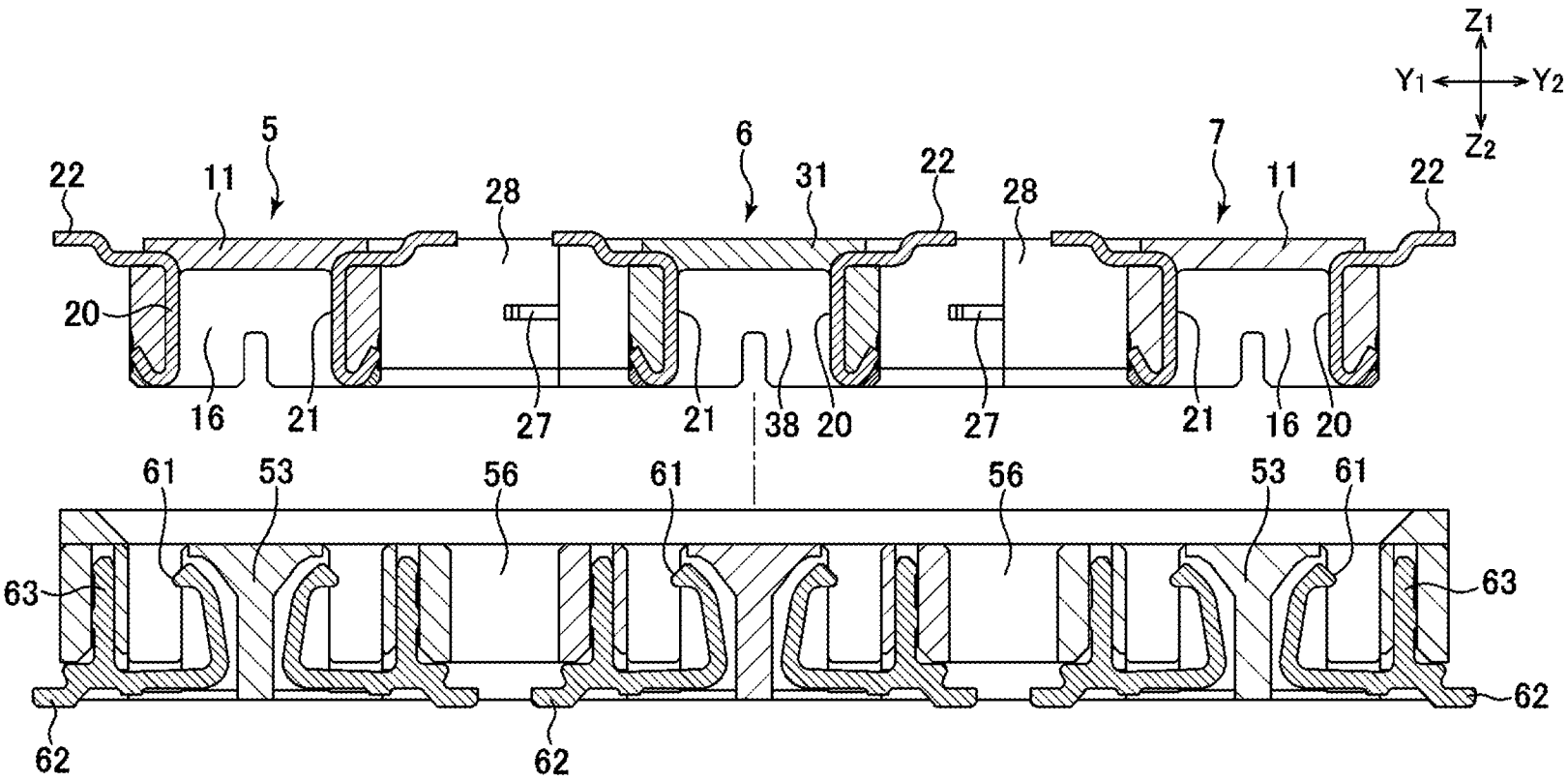
FIG. 3 is a cross-sectional view taken through section A-A in FIG. 2.
Figure 4:
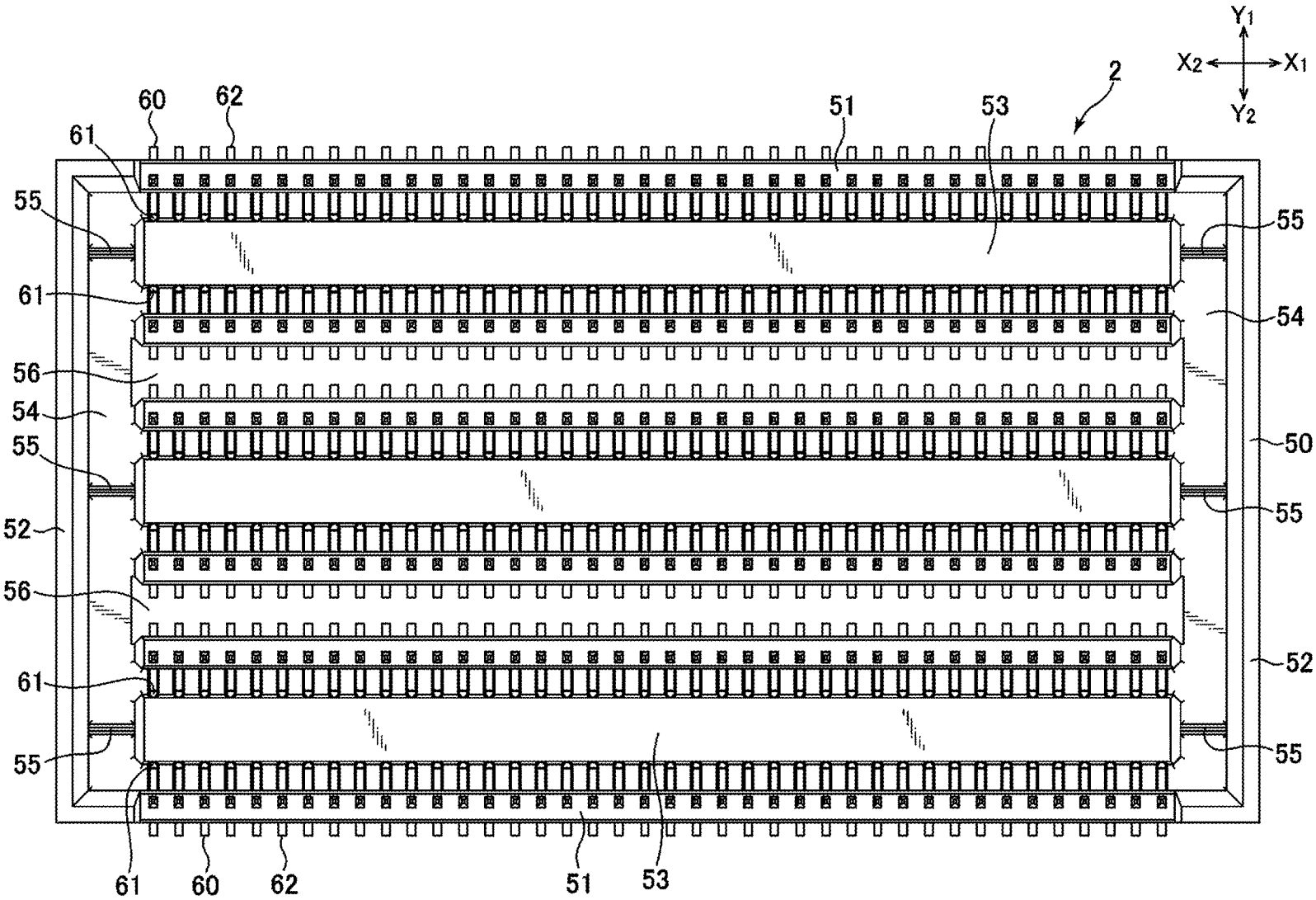
FIG. 4 is a plan view illustrating a receptacle connector configuration according to an embodiment of the present invention.
Figure 5:
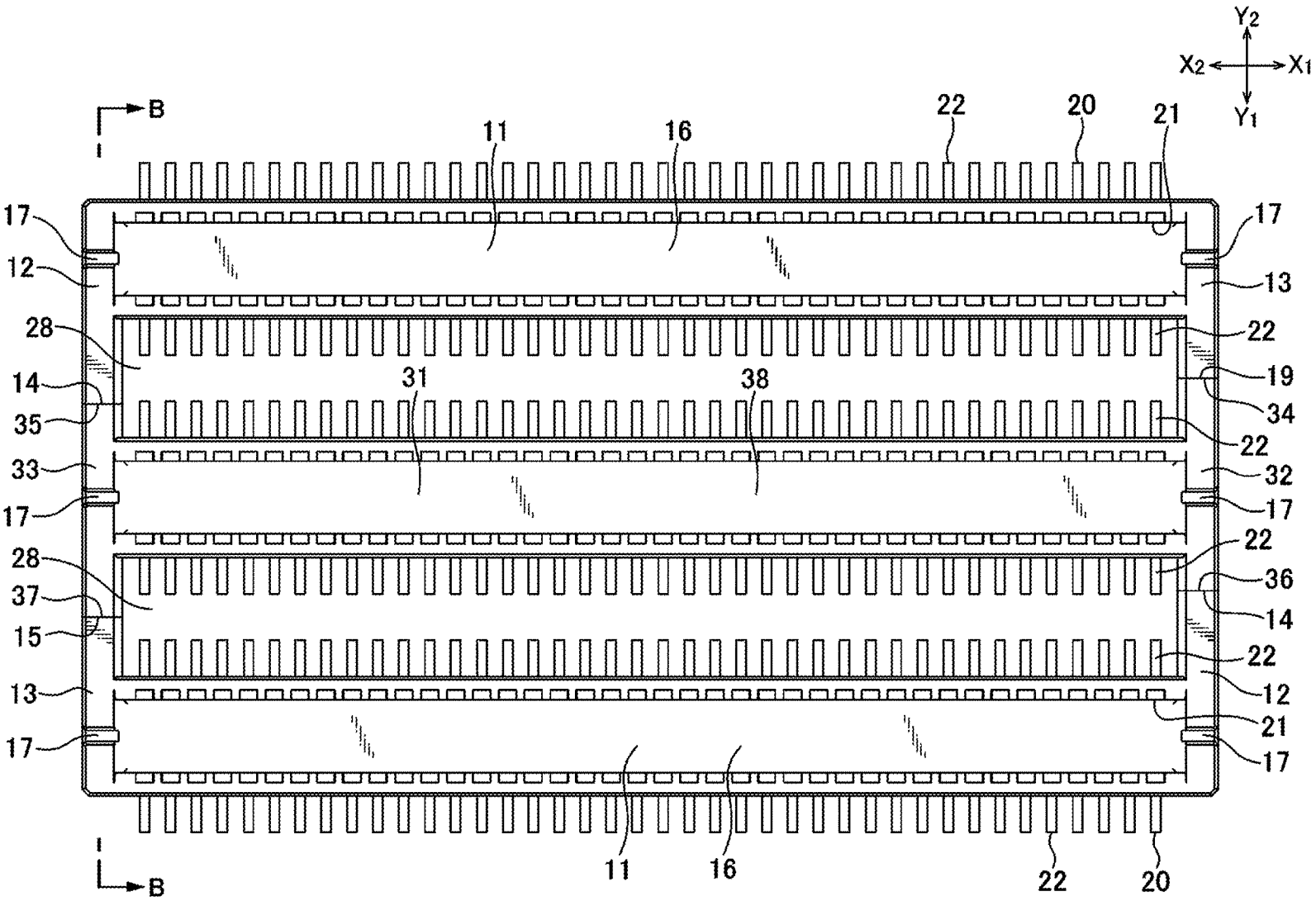
FIG. 5 is a plan view illustrating a plug connector configuration according to an embodiment of the present invention.
Figure 6:
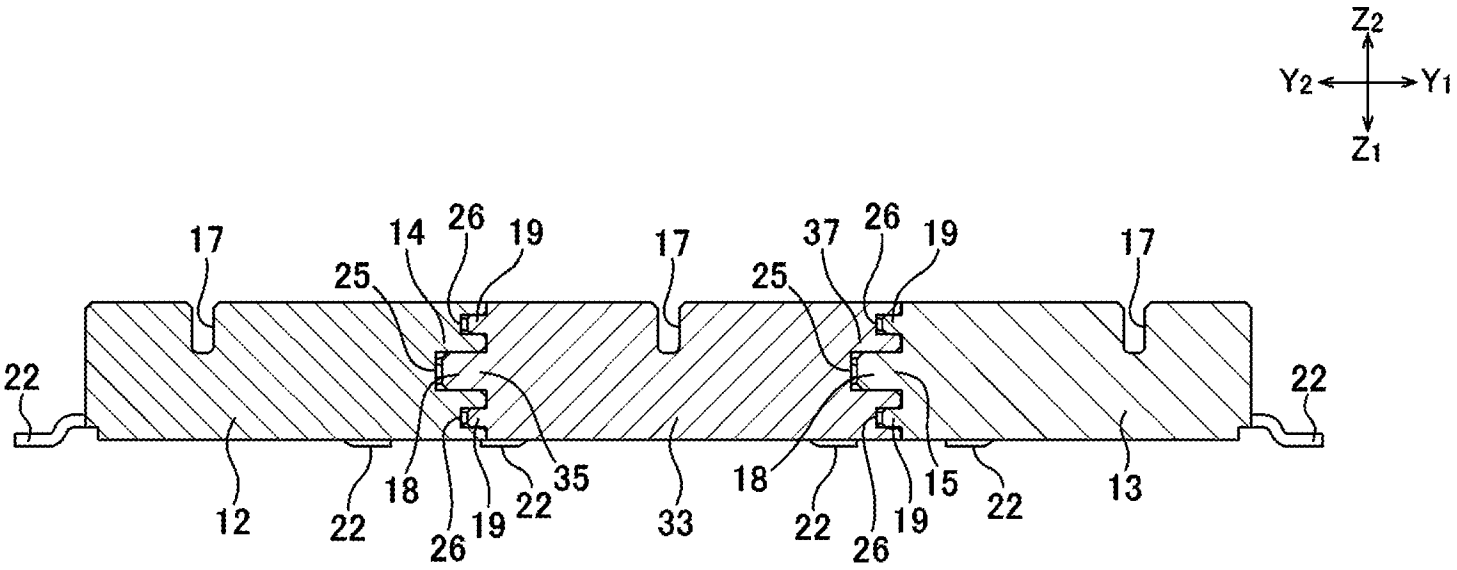
FIG. 6 is a cross-sectional view taken through section B-B in FIG. 5.
Figure 7:
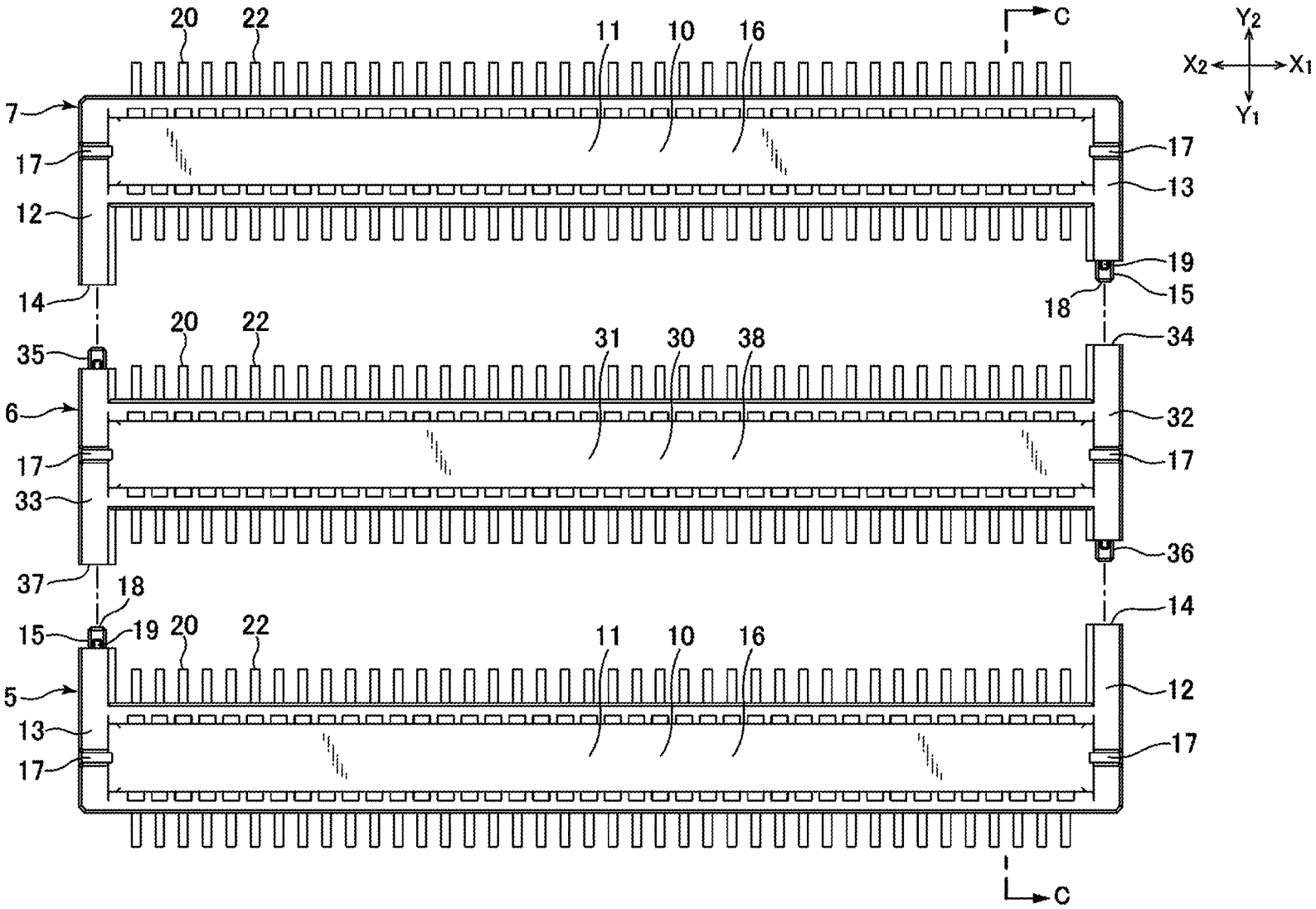
FIG. 7 is a plan view showing the plug connector illustrated in FIG. 5 in a disassembled configuration.
Figure 8:
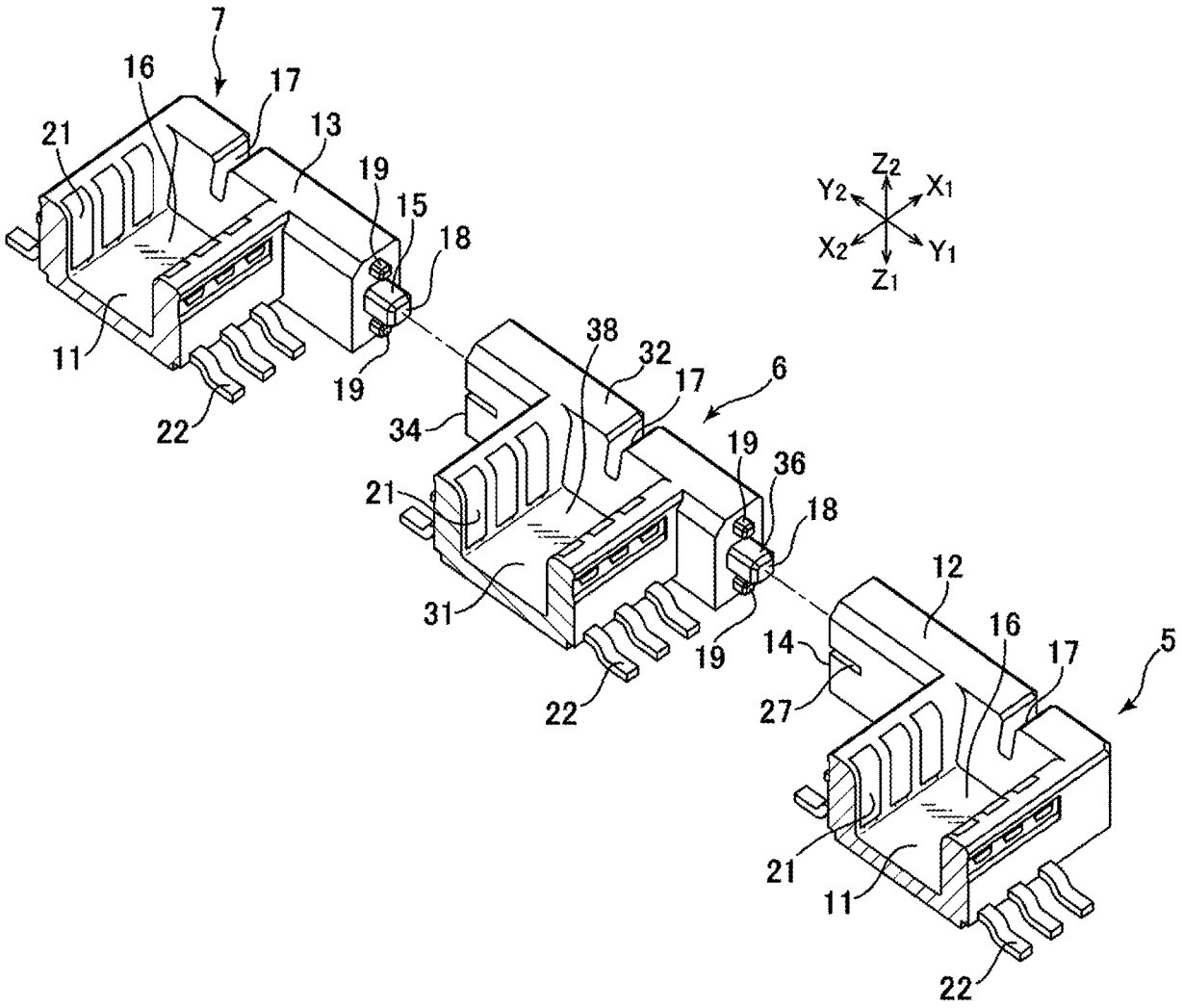
FIG. 8 is a partial perspective cross-sectional view taken through section C-C in FIG. 7.
Figure 9:
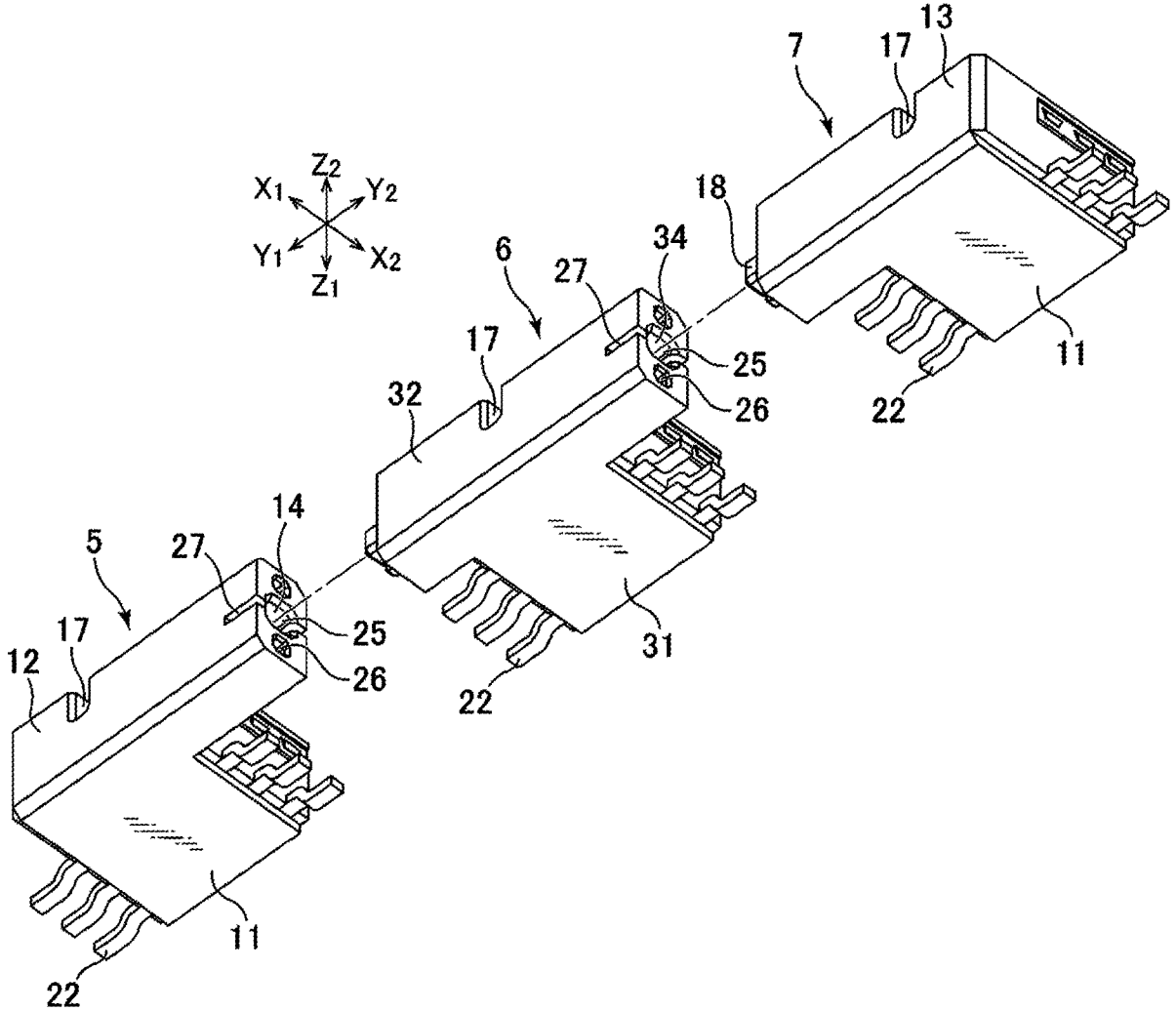
FIG. 9 is a partial perspective cross-sectional view of the plug connector illustrated in FIG. 8 in a disassembled configuration taken from a different direction.
Figure 10:
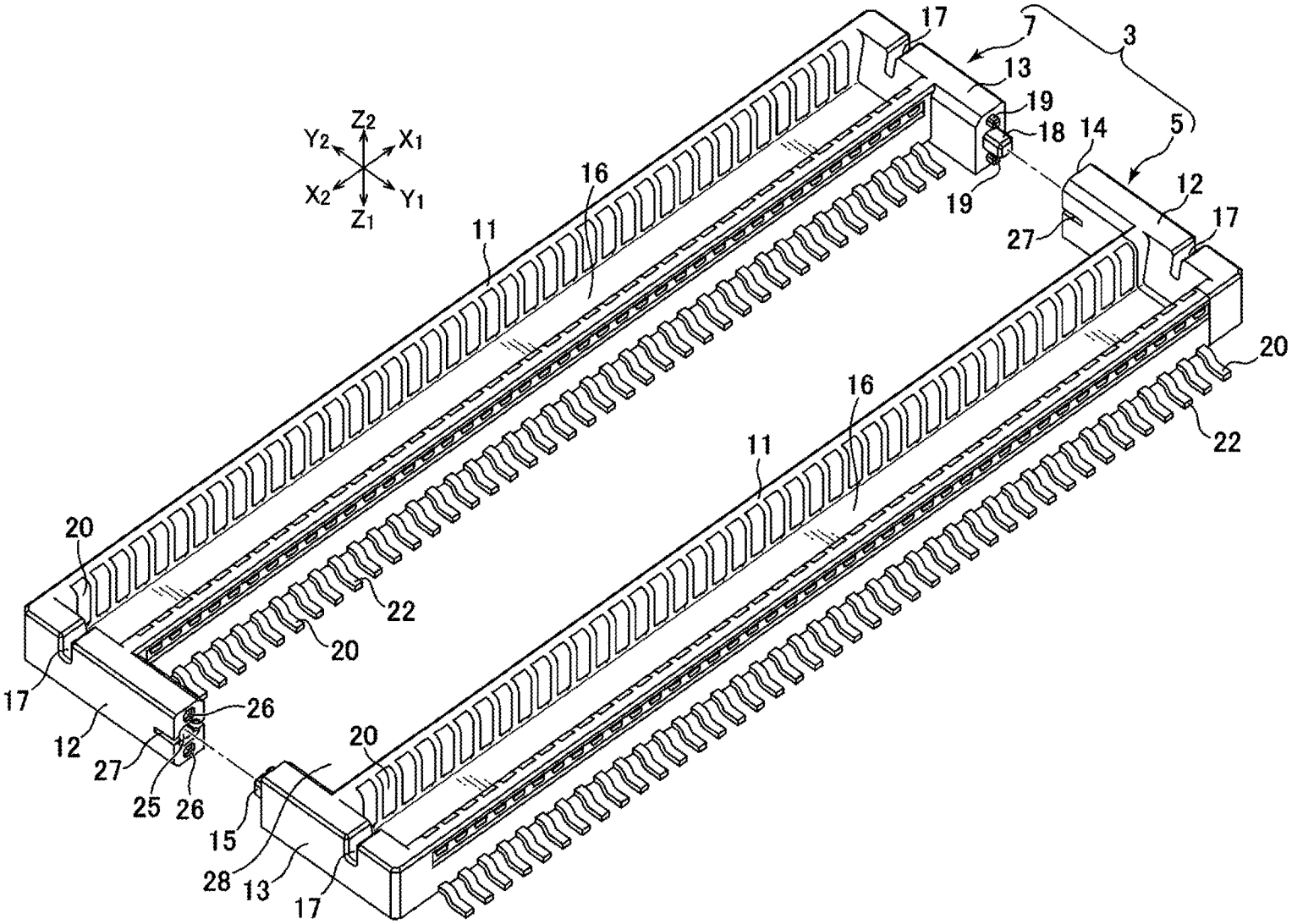
FIG. 10 is a perspective view illustrating a plug connector configuration according to another embodiment of the present invention.

FIG. 1 and FIG. 2 are, respectively, a perspective view and a front elevation view illustrating the configuration of a plug connector and a receptacle connector according to an embodiment of the present invention. FIG. 3 is a cross-sectional view taken through section A-A in FIG. 2. FIG. 4 is a plan view illustrating a receptacle connector configuration according to the present embodiment. FIG. 5 is a plan view illustrating a plug connector configuration according to the present embodiment. FIG. 6 is cross-sectional view taken through section B-B in FIG. 5. FIG. 7 is a plan view showing the plug connector illustrated in FIG. 5 in a disassembled configuration. FIG. 8 is a partial perspective cross-sectional view taken through section C-C in FIG. 7, and FIG. 9 is a partial perspective cross-sectional view thereof taken from a different direction. FIG. 10 is a perspective view illustrating a plug connector configuration according to another embodiment.

First, an exemplary configuration of a plug connector and a receptacle connector according to the present embodiment will be described with reference to FIGS. 1 to 5. The plug connector 1 and the receptacle connector (socket) 2 of the present embodiment are multi-pin electrical connectors, each mounted on a circuit board (not shown). Mating the receptacle connector 2 with the plug connector 1 brings the respectively corresponding multiple terminals 20, 60 into contact and electrically connects the terminals of the two connectors. Although the present embodiment illustrates an example with 40 terminals×2 rows×3=240 terminals, the configuration of the terminals is not limited thereto and may be modified as appropriate.

As shown in FIGS. 1 to 4, the receptacle connector (socket) 2 according to the present embodiment includes a housing 50 and multiple terminals 60 held in place in the housing 50. Around its outer periphery, the housing 50 is provided with two lateral wall portions 51, which extend in the terminal array direction (X direction), and two exterior wall portions 52, which couple the two lateral wall portions 51 and extend in the Y direction. In addition, inwardly of the lateral wall portions 51 and the exterior wall portions 52, there are provided three mating raised portions 53 used for mating with the mating recessed portions 16 of the plug connector 1. In addition, mating recessed portions 54 used for mating with the exterior wall portions 12, 13, 32, 33 of the plug connector 1 are provided between the lateral wall portions 51, the exterior wall portions 52, and the mating raised portions 53. In addition, reinforcing portions 55, which couple the mating raised portions 53 and the exterior wall portions 52, are provided within the mating recessed portions 54. In addition, the receptacle connector 2 is configured to be symmetrical both in the X direction and in the Y direction. The housing is formed as a single member.

The multiple (in the present embodiment, 40 terminals×2 rows×3=240) terminals 60, all of which have the same shape, are press-fitted into the housing 50 from the $Z_2$ direction. Of the multiple terminals 60, 40 terminals are arranged in the X direction to form a first row, and 40 terminals arranged opposite the first row to form a second row. A third and fourth row and, similarly, a fifth and sixth row, which are formed in the same manner as the first and second row, are arranged side-by-side in the Y direction. The terminals 60 include contact portions 61 that protrude at their ends in the $Z_1$ direction, board connection portions 62 that protrude at their ends in the $Z_2$ direction, and supporting portions 63 that are positioned in between the contact portions 61 and the board connection portions 62 and protrude at their ends in the $Z_1$ direction. During mating with the plug connector 1, the contact portions 61 are brought into contact with the contact portions 21 of the plug connector 1, thereby electrically connecting the terminals of the two connectors. During mounting to a circuit board, the board connection portions 62 are soldered to the circuit board. The supporting portions 63 are secured to the housing 50 by press-fitting into the housing 50. As shown in FIG. 3 and FIG. 4, spaces 56 are present between groups of 2 terminal rows, thereby allowing for the board connection portions 62 to be viewed from both sides in the $Z_1$-$Z_2$ direction.

The housing 50 is formed of an insulating material, such as a resin or plastic material, carbon fiber, or the like. The multiple terminals 60 are formed of an electrically conductive material, such as metal or the like. The multiple terminals 60 are fabricated from a single sheet of metal by blanking and folding. It should be noted that the components of the receptacle connector 2 and the materials of each component are not necessarily limited thereto.

Next, an exemplary configuration of the plug connector 1 according to the present embodiment will be described with reference to FIGS. 1 to 5. As shown in FIGS. 1 to 5, the plug connector 1 is formed by combining two types of connector units A, B such that an inner connector unit B (6) is coupled to an outer connector unit A (5), and an outer connector unit A (7) is coupled to the inner connector unit B (6). The connector unit A (7) is identical to the connector unit A (5), and the connector unit A (7) is disposed by rotating the connector unit A (5) through 180 degrees about the Z-axis. As shown in FIGS. 3 and 5, spaces 28 are present between the connector units (5-7), thereby allowing for the board connection portions 22 to be viewed from both sides in the $Z_1$-$Z_2$ direction.

The outer connector units A (5, 7) are provided with housings 10 and multiple terminals 20 held in place in the housings 10. In addition, the housings 10 include a main body portion 11, in which the multiple terminals 20 are arranged, and first exterior wall portions 12 and second exterior wall portions 13, which are provided at both ends of the main body portion 11. The first exterior wall portions 12 and the second exterior wall portions 13 extend in a direction (Y direction) perpendicular to the array direction (X direction) of the multiple terminals 20, and the first exterior wall portions 12 include first coupling portions 14 at the end in a first extension direction ($Y_2$ direction in the connector unit A (5), and $Y_1$ direction in the connector unit A (7)). The second exterior wall portions 13 include second coupling portions 15 at the end in the same direction as the first extension direction. The first coupling portions 14 and the second coupling portions 15 have mutually engageable shapes (see FIG. 6, et seq.). For example, the first coupling portions 14 and the second coupling portions 15 have a recessed shape or a raised shape. In addition, slits 17 for mating with the reinforcing portions 55 of the receptacle connector 2 are provided in the exterior wall portions 12, 13.

The inner connector unit B (6) includes a housing 30 and multiple terminals 20 held in place in the housing 30. In addition, the housing 30 includes a main body portion 31, in which the multiple terminals 20 are arranged, and a first exterior wall portion 32 and a second exterior wall portion 33, which are provided at both ends of the main body portion 31. The first exterior wall portion 32 and the second exterior wall portion 33 extend in a direction (Y direction) perpendicular to the array direction (X direction) of the multiple terminals 20, and the first exterior wall portion 32 includes a first coupling portion 34 at the end in the first extension direction ($Y_2$ direction). In addition, the first exterior wall portion 32 includes a third coupling portion 36 at the end in a second extension direction ($Y_1$ direction) opposite to the first extension direction. The second exterior wall portion 33 includes a second coupling portion 35 at the end in the same direction ($Y_2$ direction) as the first extension direction. In addition, the second exterior wall portion 33 includes a fourth coupling portion 37 at the end in the same direction ($Y_1$ direction) as the second extension direction.

As shown in FIGS. 6 to 9, the first coupling portion 34 and the second coupling portion 35 have mutually engageable shapes. The third coupling portion 36 and the fourth coupling portion 37 have mutually engageable shapes. In addition, the third coupling portion 36 has the same shape as the second coupling portion 35 and the fourth coupling portion 37 has the same shape as the first coupling portion 34. For example, the first coupling portion 34 and the third coupling portion 36 have a recessed shape, and the second coupling portion 35 and the fourth coupling portion 37 have a raised shape. Alternatively, the recessed and raised shapes may be reversed. The recessed and raised shapes have dimensions that permit mutual nesting. In addition, the exterior wall portions 32, 33 are provided with slits 17 for mating with the reinforcing portions 55 of the receptacle connector 2.

As shown in FIGS. 6 to 9, the coupling portions 14, 34, 37 have the same shapes and the same dimensions. The coupling portions 14, 34, 37 include a large recessed portion 25 in the middle of their lateral faces, two small recessed portions 26 provided on both sides of the large recessed portion 25, and a slit 27 extending in the Y direction of the large recessed portion 25. The width of the slit 27 flexibly changes depending on the size of the large raised portion 18 of the coupling portions 15, 35, 36. In addition, as far as the slit 27 is concerned, the width of the slit 27 tends to become narrower when the housing is molded. Accordingly, the slit 27 is capable of receiving the large raised portion 18 of the coupling portions 15, 35, 36.

As shown in FIGS. 6 to 9, the coupling portions 15, 35, 36 have the same shapes and the same dimensions. The coupling portions 15, 35, 36 include large raised portions 18 in the middle of their lateral faces, and two small raised portions 19 provided on both sides of the large raised portion 18. The large recessed portion 25 engages the large raised portion 18 and the small recessed portions 26 engage the small raised portions 19, thereby coupling the connector units (5-7).

As shown in FIGS. 1 to 9, in the plug connector 1 of the present embodiment, the first coupling portion 14 of the connector unit A (5) (first electrical connector) is engaged with the third coupling portion 36 of the connector unit B (6) (third electrical connector). In addition, the second coupling portion 15 of the connector unit A (5) (first electrical connector) is engaged with the fourth coupling portion 37 of the connector unit B (6) (third electrical connector). In addition, the second coupling portion 15 of the connector unit A (7) (second electrical connector) is engaged with the first coupling portion 34 of the connector unit B (6) (third electrical connector). In addition, the first coupling portion 14 of the connector unit A (7) (second electrical connector) is engaged with the second coupling portion 35 of the connector unit B (6) (third electrical connector).

Each of the connector units A (5, 7) and the connector unit B (6) has a point-symmetric shape whose central axis is the Z-axis. In each of the connector units A (5, 7) and the connector unit B (6), the multiple terminals 20 are arranged in two mutually opposed rows (40 terminals×2 rows). The multiple terminals 20 are all of the same shape.

Each of the housings 10, 30 is formed of an insulating material, such as a resin or plastic material, carbon fiber, or the like. The multiple terminals 20 are formed of an electrically conductive material, such as metal or the like. The multiple terminals 20 are fabricated from a single sheet of metal by blanking and folding. In addition, each of the connector units A (5, 7) and the connector unit B (6) is fabricated by molding the housings 10, 30 integrally with the multiple terminals 20. It should be noted that the components of the connector units A (5, 7) and the connector unit B (6) and the material of each component are not necessarily limited thereto.

Next, a plug connector 3 according to another embodiment will be described with reference to FIG. 10. The plug connector 3 illustrated in FIG. 10 is obtained by removing the connector unit B (6) from the plug connector 1 of the above-described embodiment and coupling the two connector units A (5, 7) directly. Since the connector units A, including the coupling portions, have a point-symmetric configuration, they can be coupled to one another. As shown in FIG. 10, in the plug connector 1 of this other embodiment, the first coupling portion 14 of the connector unit A (5) (first electrical connector) is engaged with the second coupling portion 15 of the connector unit A (7) (second electrical connector). In addition, the second coupling portion 15 of the connector unit A (5) (first electrical connector) is engaged with the first coupling portion 14 of the connector unit A (7) (second electrical connector). As shown in FIG. 10, when the coupling portions 14, 15 are engaged, spaces 28 are present between the connector units (5-7), thereby allowing for the board connection portions 22 to be viewed from both sides in the $Z_2$ direction.

In this manner, it becomes possible to combine the connector units and adjust the number of the terminals depending on the intended use. Although the embodiments above have described a combination of two connector units A and a combination of two connector units A with one connector unit B, the invention is not limited thereto, and, for example, may involve a combination of two connector units A and two connector units B, and the number and combinations of the connector units A, B may be modified as appropriate.

Therefore, if the electrical connector of the present embodiment is used, coupling the two types of connector units A, B in arbitrary combinations makes it possible to flexibly modify the configuration and number of the terminals depending on the intended use.

In addition, the connector units A, B of the present embodiment allow for the terminals and the housings to be integrally molded (insert-molded), which makes it possible to simplify the fabrication process and reduce manufacturing costs.

In addition, if the electrical connector of the present embodiment is used, the multiple terminals can be arranged in an efficient manner by efficiently utilizing the mounting surface area.

Although the invention conceived by the present inventors has been specifically described hereinabove with reference to embodiments, this invention is not limited to the above-described embodiments and allows for various modifications to be made without departing from its essence. In addition, the above-mentioned embodiments may be combined as appropriate.

For example, although the embodiments above have described examples in which the plug connector is made up of multiple connector units, the invention is not limited thereto and the receptacle connector may also be formed of multiple connector units. In addition, single connector units may be used as regular connectors.

For example, although the embodiments above have described connectors mounted on circuit boards, the invention is not limited thereto, and may be applicable to other types of connectors.

DESCRIPTION OF THE REFERENCE NUMERALS

1 Plug connector
2 Receptacle connector (socket)
3 Plug connector
5 Connector unit A (first electrical connector)
6 Connector unit B (third electrical connector)
7 Connector unit A (second electrical connector)
10 Housing
11 Main body portion
12 First exterior wall portion
13 Second exterior wall portion
14 First coupling portion
15 Second coupling portion
16 Mating recessed portion
17 Slit
18 Large raised portion
19 Small raised portion
20 Terminal
21 Contact portion
22 Board connection portion
25 Large recessed portion
26 Small recessed portion
27 Slit
28 Space
30 Housing
31 Main body portion
32 First exterior wall portion
33 Second exterior wall portion
34 First coupling portion
35 Second coupling portion
36 Third coupling portion
37 Fourth coupling portion
38 Mating recessed portion
50 Housing
51 Lateral wall portion
52 Exterior wall portion
53 Mating raised portion
54 Mating recessed portion
55 Reinforcing portion
56 Space
60 Terminal
61 Contact portion
62 Board connection portion
63 Supporting portion

The invention claimed is:

1. An electrical connector comprising:
a housing; and
multiple terminals held in place in the housing;
wherein the housing comprises:
a main body portion, in which the multiple terminals are arranged, and
first and second exterior wall portions, which are provided at both ends of the main body portion; the first and second exterior wall portions extending in a direction perpendicular to an array direction of the multiple terminals; the first exterior wall portions include a first coupling portion at the end in a first extension direction; the second exterior wall portions include a second coupling portion at the end in a same direction as the first extension direction; and the first and second coupling portions have mutually engageable shapes;
wherein the first exterior wall portions further comprises:
a third coupling portion at an end in a second extension direction opposite to the first extension direction, the second exterior wall portions further include a fourth coupling portion at the end in the same direction as the second extension direction, the third coupling portion having a same shape as the second coupling portion, and the fourth coupling portion has the same shape as the first coupling portion.

2. The electrical connector according to claim 1, wherein the first coupling portion has recessed portions, the second coupling portion has raised portions, and the recessed portions of the first coupling portion have dimensions that permit nesting of the raised portions of the second coupling portion.

3. The electrical connector according to claim 1, wherein multiple terminals are arranged in two mutually opposed rows.

4. The electrical connector according to claim 1, wherein the housings and the multiple terminals are fabricated by integral molding.

5. The electrical connector according to claim 1, wherein the electrical connector has a point-symmetric shape whose axis is aligned with the direction of mating.

6. An electrical connector comprising:
first and second electrical connectors, each of the first and second electrical connectors comprising:
a housing; and
multiple terminals held in place in the housing;
wherein the housing comprises:
a main body portion, in which the multiple terminals are arranged, and
first and second exterior wall portions, which are provided at both ends of the main body portion; the first and second exterior wall portions extending in a direction perpendicular to an array direction of the multiple terminals; the first exterior wall portions include a first coupling portion at the end in a first extension direction; the second exterior wall portions include a second coupling portion at the end in a same direction as the first extension direction; and the first and second coupling portions have mutually engageable shapes;

wherein the first coupling portion of the first electrical connector is engaged with the second coupling portion of the second electrical connector, and the second coupling portion of the first electrical connector is engaged with the first coupling portion of the second electrical connectors;

wherein the first exterior wall portions further comprises:

a third coupling portion at an end in a second extension direction opposite to the first extension direction, the second exterior wall portions further include a fourth coupling portion at the end in the same direction as the second extension direction, the third coupling portion having a same shape as the second coupling portion, and the fourth coupling portion has the same shape as the first coupling portion.

7. The electrical connector according to claim 6, wherein a space that permits viewing the board connection portions of the terminals in the direction of mating is present between the first electrical connector and the second electrical connector.

8. An electrical connector comprising:

first and second electrical connectors; and one or more third electrical connectors;

wherein each of the first and second electrical connectors and one or more third electrical connectors comprises:

a housing; and multiple terminals held in place in the housing;

wherein the housing comprises:

a main body portion, in which the multiple terminals are arranged, and first and second exterior wall portions, which are provided at both ends of the main body portion; the first and second exterior wall portions extending in a direction perpendicular to an array direction of the multiple terminals; the first exterior wall portions include a first coupling portion at the end in a first extension direction; the second exterior wall portions include a second coupling portion at the end in a same direction as the first extension direction; and the first and second coupling portions have mutually engageable shapes;

wherein the first exterior wall portions of each of the one or more third electrical connectors further comprises a third coupling portion at an end in a second extension direction opposite to the first extension direction, wherein the second exterior wall portions of each of the one or more third electrical connectors further comprises a fourth coupling portion at the end in the same direction as the second extension direction, the third coupling portion having a same shape as the second coupling portion, and the fourth coupling portion has the same shape as the first coupling portion, wherein the one or more third electrical connectors is disposed between the first electrical connector and the second electrical connector, the first coupling portion of the first electrical connector is engaged with the third coupling portion of the third electrical connector, the second coupling portion of the first electrical connector is engaged with the fourth coupling portion of the third electrical connector, the second coupling portion of the second electrical connector is engaged with the first coupling portion of the third electrical connector, and the first coupling portion of the second electrical connector is engaged with the second coupling portion of the third electrical connector.

9. The electrical connector according to claim 8, wherein spaces that permit viewing the board connection portions of the terminals in the direction of mating are present between the first electrical connector and the third electrical connector as well as between the third electrical connector and the second electrical connector.

* * * * *